United States Patent [19]

Decker et al.

[11] Patent Number: 4,726,338

[45] Date of Patent: Feb. 23, 1988

[54] DEVICE FOR CONTROLLING INTERNAL COMBUSTION ENGINES

[75] Inventors: Heinz Decker, Vaihingen/Enz; Richard Schleupen, Ingersheim, both of Fed. Rep. of Germany

[73] Assignee: Robert Bosch GmbH, Stuttgart, Fed. Rep. of Germany

[21] Appl. No.: 938,788

[22] Filed: Dec. 5, 1986

[30] Foreign Application Priority Data

Feb. 22, 1986 [DE] Fed. Rep. of Germany ..... 3605820

[51] Int. Cl.[4] ..... F02P 7/067

[52] U.S. Cl. ..... 123/414; 123/476; 123/617

[58] Field of Search ..... 123/149 A, 149 C, 149 D, 123/414, 599, 601, 643, 617, 416, 476; 310/70 R, 70 A

[56] References Cited

U.S. PATENT DOCUMENTS

| | | | |
|---|---|---|---|
| 3,139,876 | 7/1964 | Jukes | 123/617 X |
| 3,426,740 | 2/1969 | Hufton et al. | 123/643 X |
| 3,554,177 | 1/1971 | Hufton et al. | 123/599 X |
| 4,138,983 | 2/1979 | Espenschied | 123/643 |
| 4,210,111 | 7/1980 | Hattori et al. | 123/416 X |
| 4,414,949 | 11/1983 | Honig et al. | 123/416 X |

*Primary Examiner*—Tony M. Argenbright

*Attorney, Agent, or Firm*—Michael J. Striker

[57] ABSTRACT

A device for controlling an internal combustion engine of a motor vehicle comprises a sensor disk rotating with the shaft of the engine and a stationary signal receiving element scanning signals from the sensor disk. Sensing elements are positioned on the sensor disk. The number of these elements is proportional to the number of cylinders of the engine. Each sensing element includes a sickle-shaped portion and a lug coordinated with the signal receiving element. The control system is formed as an assembly of prefabricated structural components.

8 Claims, 2 Drawing Figures

DEVICE FOR CONTROLLING INTERNAL COMBUSTION ENGINES

BACKGROUND OF THE INVENTION

The present invention relates to a device for controlling internal combustion engines of motor vehicles, which is provided with a sensor system having a sensor rotating with the shaft of the internal combustion engine.

In controlling devices of the foregoing type, particularly for controlling ignition process, fuel injection process or the like, a sensor system for scanning an angular position of the shaft of the internal combustion engine, particularly crankshaft or cam shaft of the motor, is utilized. Such systems are formed, for example as segment systems in which sensor disks rotate together with the shaft of the motor; these discs are provided on the periphery thereof with segments the number of which is proportional to the number of cylinders of the engine, that are elongated marked regions. When the angular position of the crankshaft is scanned the number of segments corresponds to the half number of the cylinders. If the angular position of the cam shaft of the engine is scanned the number of segments is the same as the number of the cylinders in the engine because the crankshaft rotates with a double speed of the cam shaft. Thereby each segment corresponds to one cylinder in case of scanning the posititon of the cam shaft and two cylinders in case of scanning the crankshaft position, and each ignition or fuel injection process is controlled with respective segments depending on running of the motor. In the stationary signal receiving element, the front flank of the segment is detected, and by a suitable time control via total segment lengths, the control steps for the internal combustion engine are released. Segment-type systems with the same number of segments have, however the disadvantage which resides in that no arrangement sufficient for a distributor-free or two-circuit-(for example, eight cylinder-engine) high voltage distribution is possible. If one of the segments has a marking possibility a proper sensor is necessary depending on the number of cylinders in the engine. In addition, these sensor disks deviate from each other depending on the type of the vehicle Therefore a great amount of different sensor disks is necessary, the manufacture and the supporting of which are complicated.

SUMMARY OF THE INVENTION

It is an object of the present invention to provide an improved control device for internal combustion engines.

It is another object of this invention to provide a control device which would be formed as an assembly of prefabricated structural components suitable for various types of vehicles and various numbers of cylinders in the engine.

These and other objects of the invention are attained by a device for controlling an internal combustion engine of a motor vehicle, comprising a sensor system including a sensor disk rotating with a shaft of the internal combustion engine, and a stationary signal receiving element cooperating with said sensor disk, said sensor disk including structural elements affected by said signal receiving element, the number of said structural elements corresponding to the number of cylinders in said engine, said signal receiving element being connected to a control circuit for ignition, fuel injection or other system of the vehicle, said structural elements being arranged on said sensor disk as additional elements and being formed so that one control impulse or no additional control impulses are generated. Each structural element may have a sickle-shaped portion and a lug with steep flanks.

Depending on the number of cylinders in the internal combustion engine the segments or structural elements can be arranged on a standard-type sensor disk. The device is very simple because similar structural elements can be assembled together. The device can be used for many different systems. It is also possible to produce only one homogeneous segment part which can be utilized if the projection or lug is removed therefrom whereas the sickle-shaped contour thereof is maintained, this can be used for segments without marking. It should be taken into consideration during the dimensioning of the structural elements that the calculated imbalance must be zero.

Each structural element may be comprised of two discrete elements of which one element is sickle-shaped and another element is a lug with steep flanks.

The structural elements may be positioned on a front face of said sensor disk, for example glued thereto.

The structural elements may be positioned in a groove formed at a periphery of said sensor disk.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
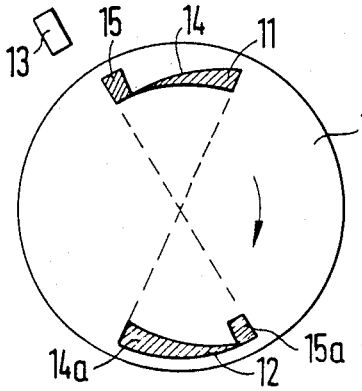
FIG. 1 is a schematic illustration of a sensor disk with segments arranged thereon, according to the invention.

Referring now to the drawings in detail, FIG. 1 shows a sensor disk of this invention designated by reference numeral 10. The sensor disk during operation of the internal combustion engine rotates with the crank shaft or the cam shaft of the engine. Two structural components 11 and 12 are provided on the end face of the sensor disk 10 in the exemplified embodiment. There structural components are in cooperation with a receiving element 13. The fashion of such cooperation or operative connecttion between the structural components 11, 12 and the receiving or register element 13 can be of any suitable convention type. When the magnetic type of the operative connection between structural components and the receiving element 13 is selected their structural components can be produced, for example by stamping from ferromagnetic sheets or by casting, and then the receiving element will be an inductive sensor which has a magnetic flow even in non-operative position.

Both structural components are of the same length and positioned diametrically opposed to each other. Furthermore, the structural components 11, 12 are each comprised of a sickle-shaped portion 14, **14*a*** and a nose or lug 15, 15*a* with steeply sloping flanks, which both are arranged in the direction of rotation of the sensor disc 10 closely subsequently one after the other. The sickle-shaped portion and the nose or lug are two discrete portions which, depending on the structural component 11 or 12, are arranged differently relative to each other. The sickle-shaped portions 14 and 14*a* are formed identically to each other and designated with different numerals for the sake of clarity as well as lugs 15, 15*a*.

Advantageously, in order to provide different structural components 11 and 12, only two parts, namely the sickle-shaped portion and the nose, are utilized in the exemplified embodiment. The sickle-shaped portion 14 of the structural component 11 is formed so that the oblique plane of this portion 14, that is the side facing the periphery of the sensor disk 10 or receiving element 13, ascends in the direction opposite to the direction of rotation of the sensor disc. Nose 15 is arranged at the foot of the sickle-shaped portion 14, that is at the outlet of the oblique plane. Lug 15 and the sickle-shaped portion 14 must be directly connected to each other in order to avoid wrong impulses. The lug 15 and sickle-shaped portion 14 have the same height.

In the structural component 12 the lug 15*a* faces towards the central point of the sensor disk 10. The sickle-shaped portion 14*a* is displaced so that it has a circular contour at the side of the structural component 12, which faces the periphery of the sensor disk 10. The central point of this contour coincides with the central point of the sensor disk 10. Thus the circular contour is obtained in which the outlet of the sickle-shaped portion 14 is offset from the foot of the lug 15 to its head. It is obvious that the head of the lug 15 must be circular. The head of the lug 15 must thereby seamlessly merge into the contour of the structural component 12. It also has the same radius as the oblique plane of the sickle-shaped portion 14. Thus it is possible to selectively assemble both structural components with uniform sickle-shaped portions 14 and lugs 15. Thus the assembly of prefabricated structural components is very easy. However, imbalance ratios must be taken into consideration due to various center-of-gravity ratios and thus centrifugal forces acting on the structural components 11, 12. The calculated imbalance must be always zero.

In the embodiment shown in FIG. 1, the sensor disk 10 is secured to the crankshaft of the internal combustion engine and is suitable for controlling four-cylinder motors. Should the sensor disk 10 be utilized for internal combustion engines with eight cylinders three structural components 12 and one structural component 11 should be provided on the sensor disk at equal angular distances from each other. To coordinate impulses with individual cylinders only the lug 15 is necessary.

Figure 2:
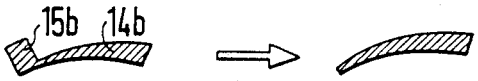
FIG. 2 is a sectional view of the one-part segment before and after the removal of the second part.

It is also conceivable that the structural component 11 be formed of one piece as shown in FIG. 2. The lug 15*b* and the sickle-shaped portion 14*b* are thus rigidly connected to each other. In order to obtain now the structural component 12, the lug 15*b*, under the maintaining of the circular contour of the sickle-shaped portion up to the outlet of this portion, is separated from this portion. This can be carried out, for example by cutting or milling. The length of the structural components is not however changed.

It is also possible to arrange the structural components 11, 12 not on the end face of the sensor disk but insert them in a groove formed in the peripheral face of the sensor disk. Thereby an assembly of prefabricated structural components is also possible.

When the sensor disk 10, as shown in FIG. 1, rotates in clockwise direction firstly the front flank of, for example structural component 12 is scanned by the signal receiving element 13. The ignition process can be, for example released in accordance with the angular position between the start of the structural component 12 and the rear flank of the lug 15*a*. The signals generated by structural components 11, 12, 15, 15*a* in the signal receiving element are fed to the control circuit for ignition, fuel injection or other systems of the vehicle. Thus an exact coodination of the ignition impulse for a distributor-free high voltage distribution is possible with a single sensor, the mode of operation of which is generally known and is therefore not described herein in detail.

It will be understood that each of the elements described above, or two or more together, may also find a useful application in other types of devices for controlling internal combustion engines differing from the types described above.

While the invention has been illustrated and described as embodied in a device for controlling an internal combustion engine, it is not intended to be limited to the details shown, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In a device for controlling an internal combustion engine of a motor vehicle, comprising a sensor system including a sensor disk rotating with a shaft of the internal combustion engine, and a stationary signal receiving element cooperating with said sensor disk, said sensor disk including structural elements generating impulses and affected by said signal receiving element, said signal receiving element being connected to a control circuit for ignition, fuel injection or other system of the vehicle, the improvement comprising said structural elements being arranged on said sensor disk as additional segments and being formed each of at least two discrete but combinable elements, and the number of said discrete and combinable elements on said sensor disk being equal to the number of cylinders in said engine, said structural elements being formed so that a single additional control impulse or no additional control impulse is generated on a respective structural element.

2. The device as defined in claim 1, wherein one of said discrete elements is sickle-shaped and another of said discrete elements is a lug with steep flanks.

3. The device as defined in claim 1, whereby said structural elements are positioned on a front face of said sensor disk.

4. The device as defined in claim 1, wherein said structural elements are positioned in a groove formed at a periphery of said sensor disk.

5. The device as defined in claim 1, wherein said structural components are of the same length.

6. The device as defined in claim 3, wherein said structural elements are glued to the front face of said sensor disk.

7. A method of oontrolling an internal combustion engine of a motor vehicle by means of a sensor disk rotating with a shaft of the engine and a stationary signal receiving element cooperating with said sensor disk, comprising the steps of providing on said disk structual components each including a sickle-shaped portion and a lug which are discrete elements separable from each other and combinable with each other, and assembling and placing said sickle-shaped portions and lugs on said disk so that the number of said sickle-shaped portions and lugs is equal to the number of cylinders of said engine.

8. The method as defined in claim 7, wherein one of said structural elements (12) is made by separating a lug of a structural element from a remaining portion thereof and a sickle-shaped contour of said structural element is maintained up to an outlet of a sickle.

* * * * *